US009127328B2

(12) United States Patent
Poloni

(10) Patent No.: US 9,127,328 B2
(45) **Date of Patent: *Sep. 8, 2015**

(54) TILTABLE OXYGEN CONVERTER

(75) Inventor: Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 102 days.

This patent is subject to a terminal disclaimer.

(21) Appl. No.: 13/983,797

(22) PCT Filed: Feb. 23, 2012

(86) PCT No.: PCT/IB2012/050823

§ 371 (c)(1),
(2), (4) Date: Aug. 6, 2013

(87) PCT Pub. No.: WO2012/114294

PCT Pub. Date: Aug. 30, 2012

(65) Prior Publication Data

US 2013/0334745 A1 Dec. 19, 2013

(30) Foreign Application Priority Data

Feb. 24, 2011 (IT) ..... MI11A0280

(51) Int. Cl.
*C21C 5/50* (2006.01)
*C21C 5/46* (2006.01)

(52) U.S. Cl.
CPC ..... *C21C 5/50* (2013.01); *C21C 5/4633* (2013.01)

(58) Field of Classification Search
CPC ..... C21C 5/50; C21C 5/4633
USPC ..... 266/246, 248
See application file for complete search history.

(56) References Cited

U.S. PATENT DOCUMENTS

| | | | | |
|---|---|---|---|---|
| 4,266,758 | A * | 5/1981 | Schmitz | 266/244 |
| 4,700,929 | A * | 10/1987 | Langlitz et al. | 266/246 |
| 5,364,079 | A | 11/1994 | Gruber et al. | |
| 2013/0334745 | A1 * | 12/2013 | Poloni | 266/248 |
| 2014/0159288 | A1 * | 6/2014 | Poloni et al. | 266/200 |

FOREIGN PATENT DOCUMENTS

| | | |
|---|---|---|
| CN | 101638710 | 2/2010 |
| EP | 0143242 | 6/1965 |
| GB | 1218441 | 1/1971 |

* cited by examiner

*Primary Examiner* — Scott Kastler
(74) *Attorney, Agent, or Firm* — Stetina Brunda Garred & Brucker

(57) ABSTRACT

A converter comprising a container (2) defining a first axis (X); a support ring (3), coaxial to the container (2) and spaced therefrom, equipped with two diametrically opposite supporting pins (6), defining a second axis (Y) which is orthogonal to the first axis (X), adapted to allow the converter to be rotated about said second axis; suspension elements, connecting said container (2) to said support ring (3), restrained at a first end to the container (2) and at a second end to the support ring (3); in which said suspension elements comprise at least three first bars (7) arranged parallel to the first axis (X) and substantially equidistant from each other along said support ring; at least two second bars (8, 8'), each second bar (8, 8') being orthogonal to said second axis (Y) and diametrically opposite with respect to the other second bar (8', 8); at least one third bar (9) being arranged parallel to a first plane (X-Y) defined by said first axis (X) and second axis (Y); wherein all said bars are fixed-end bars.

18 Claims, 8 Drawing Sheets

TILTABLE OXYGEN CONVERTER

FIELD OF THE INVENTION

The present invention relates to a tiltable oxygen converter equipped with a suspension system of the container of the converter, connecting said container to a support ring.

STATE OF THE ART

The main object of an oxygen converter is to convert the cast iron produced in the blast furnace into raw liquid steel, which may be later refined in the secondary steel production department.

The main functions of the oxygen converter, known also as B.O.F. (basic oxygen furnace), are to decarbonize and remove the phosphorus from the cast iron and optimize the temperature of the steel so that further treatments may be implemented before casting with minimum heating and cooling of the steel.

The reactions of exothermic oxidation generated in the converter generate a lot of thermal energy, more than what is required to reach the determined temperature of the steel. This extra heat is used to melt the scraps and/or additions of ferrous mineral and, during the conversion process, determines thermal expansions of the container.

An example of an oxygen converter belonging to the state of the art is described in document U.S. Pat. No. 5,364,079.

Such a converter consists of a container, defining the reactor and substantially cylindrical shaped, supported by a support ring, surrounding the container and conveniently spaced therefrom, equipped with two diametrically opposite supporting pins ("trunnions"), whose shaft is operated by a tilting mechanism.

The converter is supported by means of an outer support ring and a suspension consisting of a plurality of articulated braces and related supports, arranged on the lower side of the support ring when the converter is in vertical position. Each articulated support is designed to be fixed, by means of ball joints, to the support ring on one side and to the container on the other side.

Thereby, the converter is supported by a series of articulated supports which allow self-aligning between outer support ring and container.

Although the system described allows self-aligning between the two units, the presence of several ball joints disadvantageously determines a non-negligible maintenance of the latter, with constant greasing and preventive replacement of the joints given the demanding operating conditions they are subjected to.

The centering between container and support ring is also important to suitably allow the deformations or thermal expansions of the container due to the high temperatures reached during the conversion process.

Thus the need is felt to make an oxygen converter which allows overcoming the aforesaid drawbacks.

SUMMARY OF THE INVENTION

The main object of the present invention is to make an oxygen converter equipped with a suspension system of the container, connecting said container with the support ring thereof, which does not require maintenance, thus allowing ordinary and extraordinary interventions to be eliminated and allowing the replacement of the elements subject to wear to be decreased to zero.

Another object of the invention is to make an oxygen converter whose suspension system of the container is capable of keeping an accurate centering between container and support ring in all the operating steps of the converter.

Another object of the invention is to make a converter whose suspension system is capable of absorbing the thermal expansions of the container with respect to the support ring thereof.

A further object of the invention is to make a converter whose suspension system is capable to absorbing the vibrations induced by the melting process.

Thus, the present invention proposes to achieve the objects discussed above by making a tiltable converter which, according to one embodiment, comprises:

- a container defining a first axis X;
- a support ring, coaxial to the container and spaced from said container, equipped with two diametrically opposite supporting pins, defining a second axis Y which is orthogonal to the first axis X, adapted to allow the converter to be rotated about said second axis Y;
- suspension elements, connecting said container to said support ring, restrained at a first end to the container and at a second end to the support ring;

wherein said suspension elements comprise

- at least three first bars arranged parallel to the first axis X and substantially equidistant along said support ring;
- at least two second bars, each second bar being orthogonal to said second axis Y and diametrically opposite with respect to the other second bar;
- at least one third bar arranged parallel to a first plane X-Y defined by said first axis X and second axis Y;

wherein said at least three first bars, said at least two second bars and said at least one third bar are fixed-end bars.

Four second bars are provided in a first advantageous variant, a first pair of said second bars being diametrically opposite with respect to the second pair. One bar in each pair of second bars is arranged at a first side of a second plane Y-Z which is orthogonal to the first plane X-Y, while the other bar in the same pair is positioned at a second side of plane Y-Z.

Two second bars are provided in a second advantageous variant, which are both arranged at a first side or at a second side of plane Y-Z.

In both the variants, said at least one third bar is arranged at the first side or at the second side of plane Y-Z. Two third bars may be provided, one arranged at the first side of plane Y-Z, while the other is positioned at the second side of plane Y-Z.

Said at least three first bars orthogonally cross the plane Y-Z.

The second bars are arranged close to the supporting pins and the third bar(s) is(are) spaced angularly by about 90° from said second bars.

In particular, the restrained end elastic bars of the overhanging system of the converter, object of the present invention, have the following advantages:

- they allow the thermal expansions of the container to be easily absorbed;
- they effectively absorb the vibrations generated during the insufflation of the oxygen into the container;
- they effectively absorb the forces generated by the inertia of the container at the end of a rotation thereof;
- they require no maintenance with respect to traditional systems which use joints and pins subject to wear;
- they keep the container centered with respect to the support ring, with high accuracy under all conditions of tilting;
- they require extremely simple assembly;

they occupy less space with respect to known solutions, also with respect to "lamella"-type suspension elements;

they are suitable for all sizes of converters, with a variable diameter thereof for example of about 5 m to about 8 m and a variable height of about 7 m to about 11 m.

The high accuracy of the centering between container and support ring promotes the thermal expansions of the container, caused by the high temperatures reached during the conversion process, without any interference between container and support ring.

The dependent claims describe preferred embodiments of the invention.

BRIEF DESCRIPTION OF THE FIGURES

Further features and advantages of the invention will be more apparent in light of the detailed description of preferred, but not exclusive, embodiments of an oxygen converter, disclosed by way of a non-limiting example, with the aid of the accompanying drawings in which.

The same reference numerals in the figures identify the same elements or components.

DETAILED DESCRIPTION OF PREFERRED EMBODIMENTS OF THE INVENTION

Figure 1:
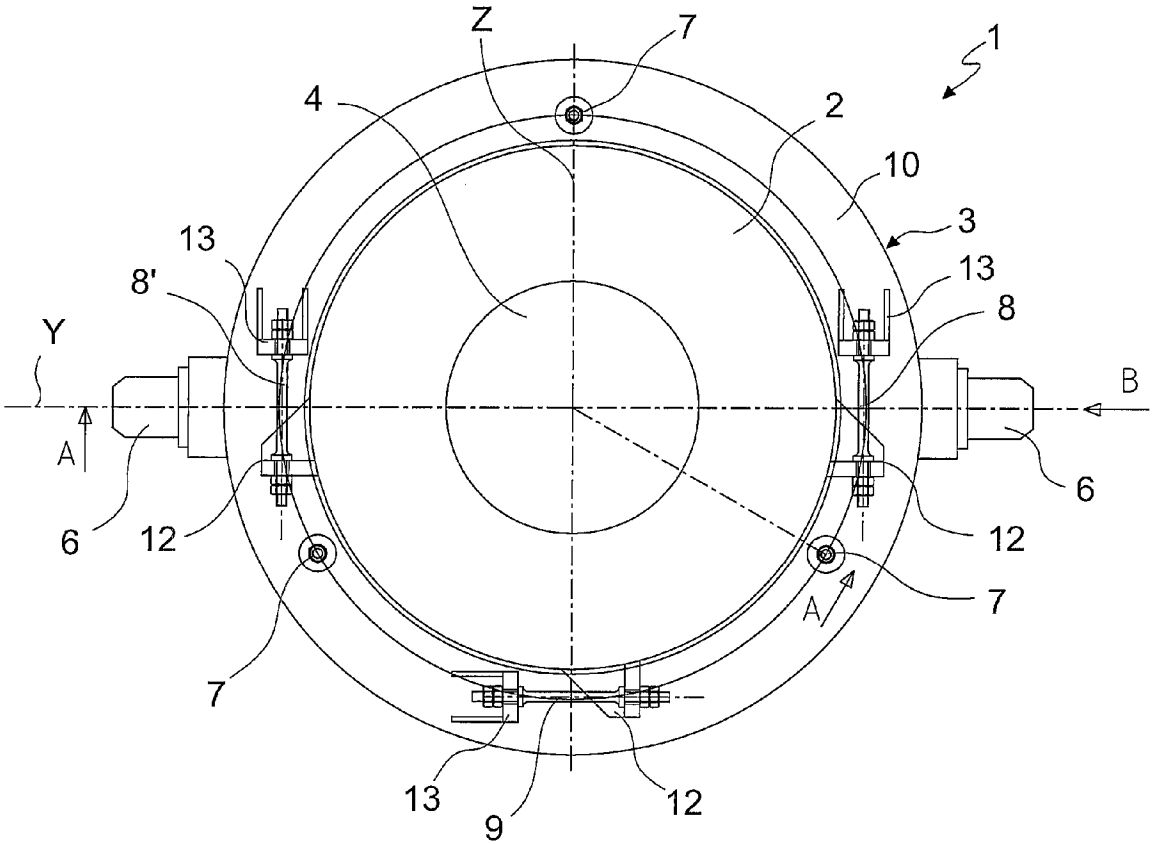
FIG. 1 shows a top view of a first embodiment of an oxygen converter according to the invention.

With reference to the Figures, a preferred embodiment is shown of an oxygen converter, globally indicated with reference numeral 1.

Such a converter 1 comprises:

a container or tank 2, defining an axis X, equipped with a loading mouth 4 of the scrap and of the liquid cast iron, and equipped with a side hole 5 for tapping the liquid steel obtained at the end of the conversion process;

a support ring 3 for supporting the container 2, said ring 3 being arranged coaxially to the container 2 and conveniently spaced therefrom;

two supporting pins or tilting pins 6 of said support ring 3, known as "trunnions", which are diametrically opposite to each other and define an axis Y, which is orthogonal to axis X, with at least one of said supporting pins 6 connected to a tilting mechanism (not shown);

suspension elements, which connect the container 2 to the support ring 3 and which also perform the centering function between container and ring.

Figure 2:
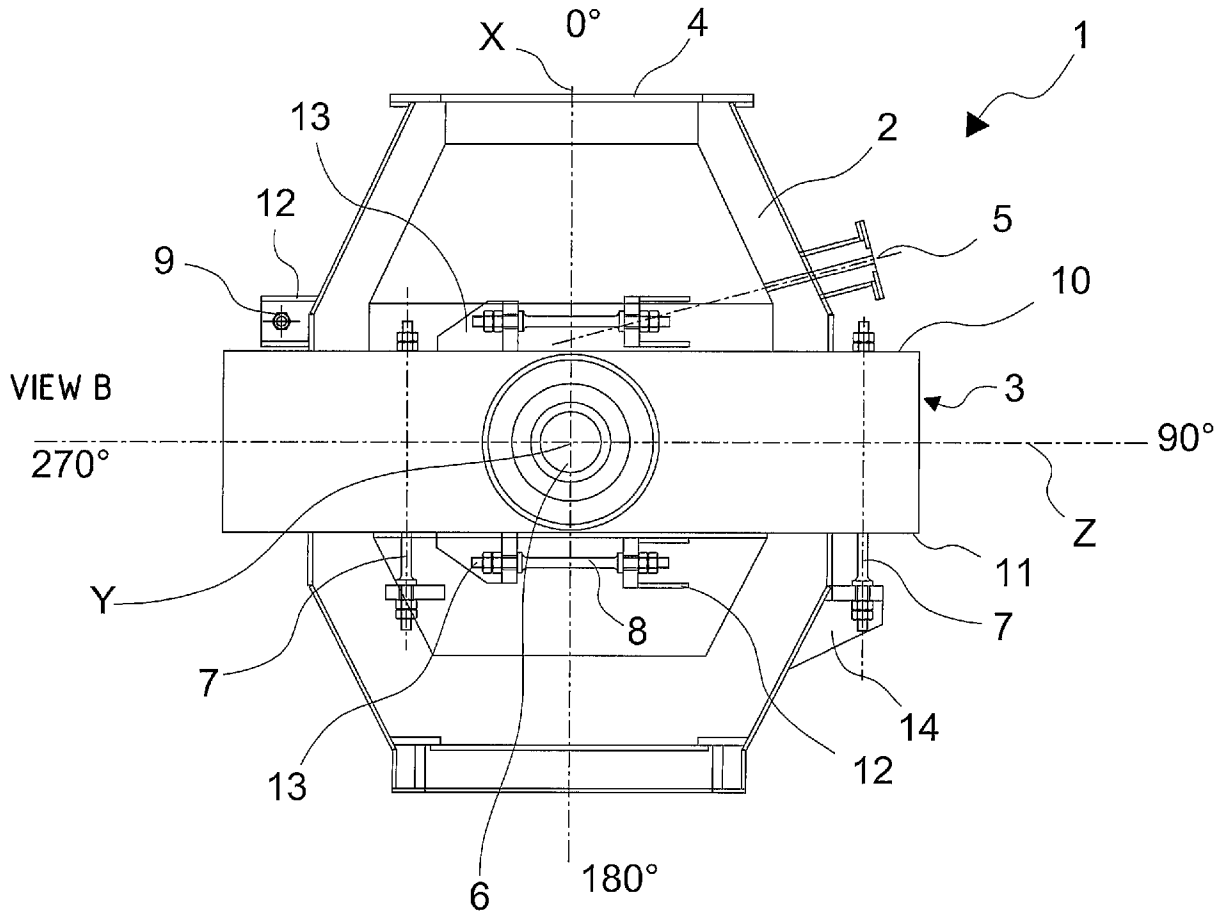
FIG. 2 shows a partial sectional view of the converter in FIG. 1, according to the planes identified from broken line A-A in FIG. 1.

The support ring 3, which is arranged at the middle zone of the container 2, is hollow and preferably has a rectangular cross section (FIG. 2). Ring 3 has a first surface 10 facing the part of the container comprising the loading mouth 4; a second surface 11, opposite to the surface 10, facing the part of the container comprising the bottom thereof; a third inner surface 21 facing the middle part of the container; a fourth outer surface 20 opposite to the inner surface 21.

The suspension elements are advantageously longitudinal bars which are fixed at a first end to the container 2, and at a second end to the support ring 3. Said bars are conveniently sized to operate as elastic support means for absorbing the expansions.

Said longitudinal bars preferably have a circular section. However, other section shapes may be provided based on the designed longitudinal extension of the bars. The bars are preferably made of spring steel or other suitable steel with similar features of elasticity.

Figure 3:
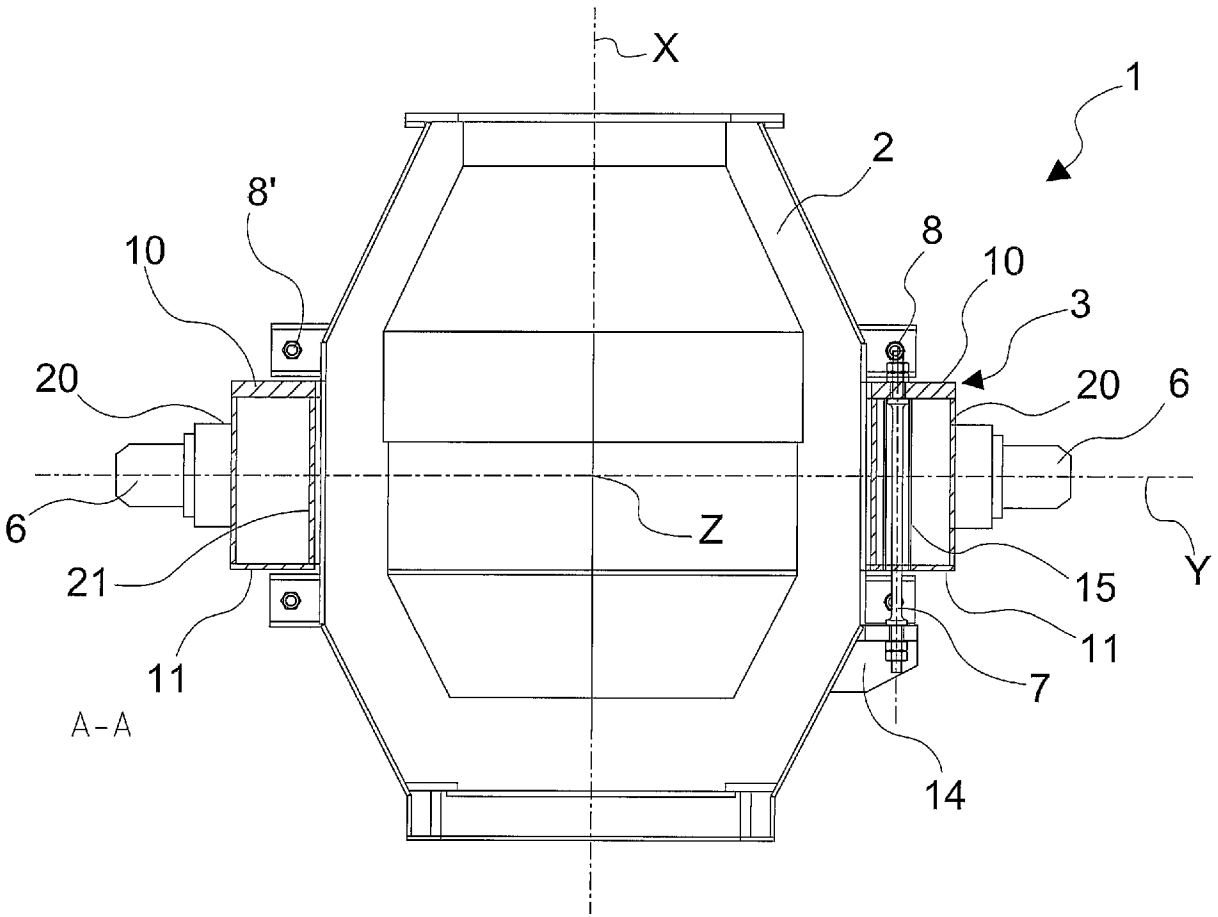
FIG. 3 shows a side view of the converter in FIG. 1, according to the direction indicated by arrow B.

With reference to FIGS. 1 to 3, which show the converter of the invention in its straight position with the loading mouth 4 facing upwards, a first advantageous variant of the invention provides:

three first bars 7 arranged parallel to axis X at an equal angular distance from each other (120°);

four second elastic bars 8, 8', arranged two by two close to a respective supporting pin 6, on planes parallel to each other and to axis X, respectively, equidistant from said axis X and orthogonal to a first plane X-Y defined by the axis X and by the axis Y;

at least one third elastic bar 9 arranged parallel to said first plane X-Y, spaced angularly by about 90° from said second elastic bars 8.

Two third elastic bars 9 may be provided, arranged on a further plane parallel to said first plane X-Y.

The distance of the second elastic bars 8, 8' from the axis X is equal to the distance of the third elastic bar(s) 9 from said same axis X.

All the elastic bars 7, 8, 9 are substantially arranged, in the plan view, along a circumference (FIG. 1). Hence, they are substantially arranged along the side surface of a cylinder.

The second and the third elastic bars 8, 8', 9 are restrained at one end to the container 2, and at the other end to the support ring 3 by means of bolting on a respective fastening bracket 12, 13: hence the constraint is a fixed joint (fixed beam). The fastening brackets 12, 13 soldered or bolted to the container 2 and to the ring 13 have through holes into which the bars are inserted; the ends of such bars are threaded and their locking on the brackets occurs by means of nuts.

The first elastic bars 7 are restrained at one end to the container 2 by means of bolting on fastening brackets 14. Instead, they are restrained on the other end by means of bolting directly on the first surface 10 of the support ring 3. The constraint is also a fixed joint hereto (fixed beam). Both fastening brackets 14, soldered or bolted to the container 2, and the first surface 10 of the ring 3 have through holes into which the elastic bars 7 are inserted; the ends of such bars are threaded and their locking on the brackets 14 and on the first surface 10 of the ring occurs by means of nuts. The elastic bars 7 cross, with at least one end thereof, the cavity of the ring 3 inside a respective sleeve 15 serving the function of delimiting the passage channel of the respective bar 7.

By defining a further axis Z as the axis which is orthogonal to the plane X-Y and passes through the point of intersection of the axes X and Y, there are identified a second plane Y-Z, which may be considered a "equatorial" plane of the converter, and a third plane X-Z, both said planes being orthogonal to the first plane X-Y.

With reference to FIGS. 1 to 3 (converter in straight position), the first elastic bars 7 are fixed to the container 2 in a position below the support ring 3, that is below the plane Y-Z;

while they are fixed to the ring 3 directly on the first surface 10 of the latter, that is above the plane Y-Z.

In particular, the three first elastic bars 7 are arranged at 120° from each other (FIG. 1) to have an isostatic balance. It is however possible to also provide more than three first elastic bars, again angularly equidistant from each other.

Advantageously, the axis of one of the three longitudinal bars 7 rests on the third plane X-Z (FIG. 1) and the at least one third elastic bar 9 is arranged diametrically opposite (180°) to said first elastic bar. Accordingly, the second elastic bars 8 are arranged at an angular distance of ±90° from the first elastic bar 7 resting on the plane X-Z.

The first elastic bars 7 preferably have a length L1 greater than length L2 of the second and third elastic bars 8, 8', 9.

In a further variant, the length of the second bars 8, 8' is different from the length of the third bars 9.

In all cases, all bars 7, 8, 8', 9 are sized so as to have a length which is suitable for operating in elastic field with infinite lifetime.

With reference to the converter in its straight position (FIGS. 1 to 3), the two pairs of second elastic bars 8, 8' are symmetrically arranged with respect to the plane X-Z.

One bar in each pair is fixed in a position above the support ring 3, that is above the plane Y-Z, while the other bar in the same pair is fixed in a position below the support ring 3, that is below the plane Y-Z. In particular, in the variant in FIG. 3, one bar is arranged close to the first surface 10 of the ring, and the other bar close to the second surface 11 of the ring.

The second elastic bars 8, 8' in each pair may be symmetrically arranged with respect to the plane Y-Z (FIG. 3).

Instead, the third elastic bar 9 is fixed above the support ring 3, that is above the plane Y-Z, preferably close to the first surface 10. Alternatively, the third elastic bar 9 may be fixed below the support ring 3, that is below the plane Y-Z.

When there are two third elastic bars 9, they may be symmetrically arranged with respect to the plane Y-Z.

The two supporting pins 6, which are operated by at least one tilting mechanism, allow the rotation of the converter about the axis Y.

Figure 4:
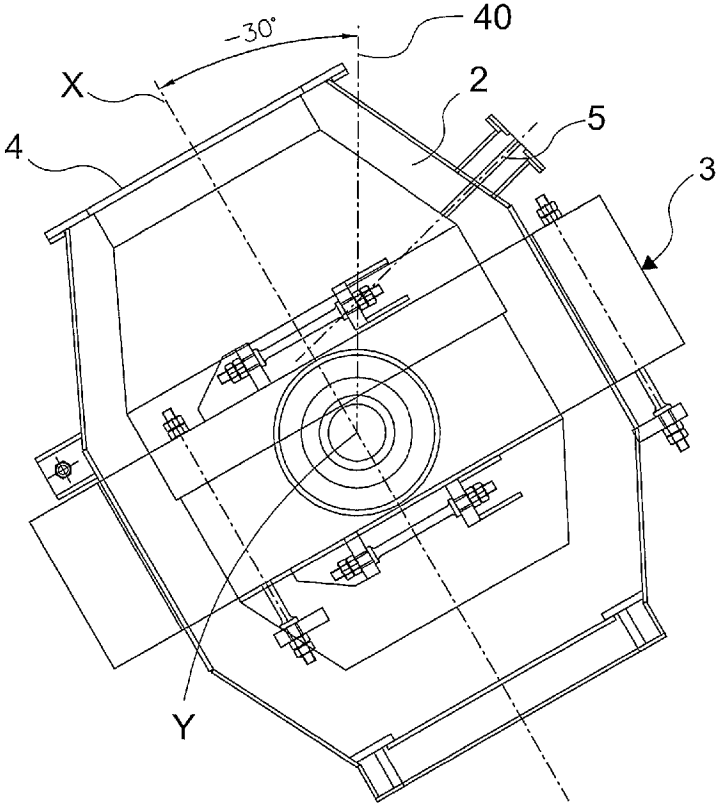
FIG. 4 shows the converter in FIG. 3, in a first operating position.

The converter usually goes from a first position, in which it is in its vertical position with the loading mouth 4 facing upwards (FIG. 3), to a second position tilted by about −30° with respect to the vertical 40 (FIG. 4), by means of rotating the supporting pins 6 in a first rotation direction. The loading of the liquid cast iron and of the scrap through mouth 4 occurs in the position in FIG. 4.

After loading, the converter returns to the first position in FIG. 3. A lance, introduced in the container through the mouth 4, blows in oxygen for a predetermined period of time so as to drastically lower the carbon content and decrease the concentration of impurities like sulphur and phosphorus.

Figure 5:
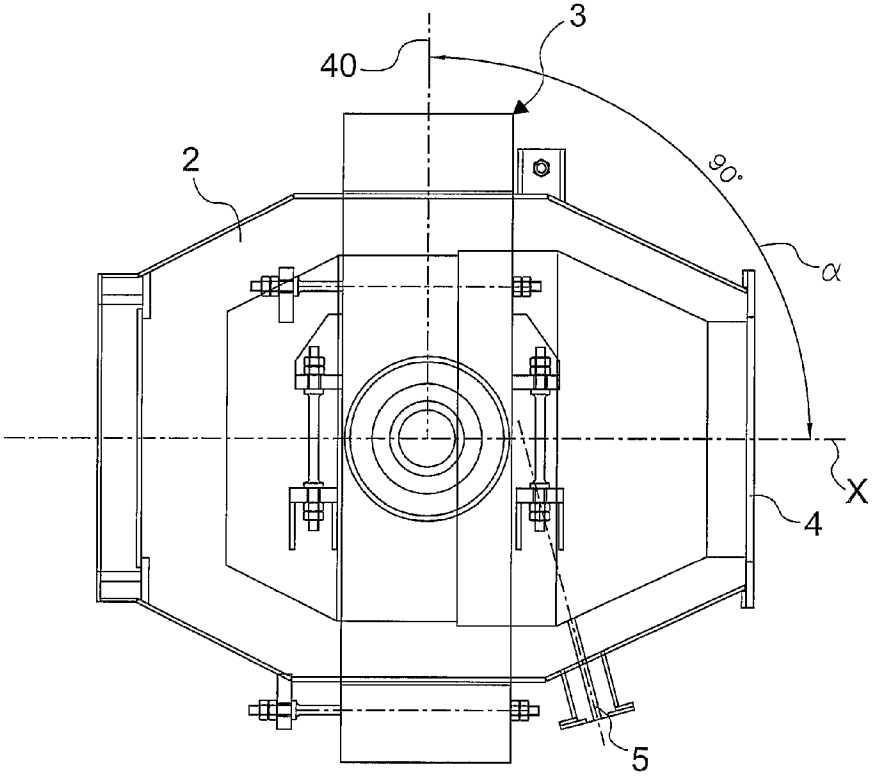
FIG. 5 shows the converter in FIG. 3, in a second operating position.

Once the conversion into raw liquid steel is complete, the converter goes from the first position in FIG. 3 to a third position (FIG. 5) tilted by about 90° with respect to the vertical 40 (FIG. 4), by means of rotating the supporting pins 6 in a rotation direction opposite to the first rotation direction. In this third position the liquid steel is tapped through the tapping hole 5.

With this first variant of the invention (shown in the figures), the load, determined by the sum of the weights of container 2, of the liquid cast iron and of the scrap is unloaded onto the ground through the support ring 3, the elastic bars 7, 8, 8' and 9, the tilting pins 6 and the related supports.

In particular, the configuration of the elastic bars 7, 8, 8' and 9 allows the weight to be absorbed for any tilt of the container 2.

The first elastic bars 7 substantially act as tie rods for tilting angles of the converter with respect to the vertical, between 0° (position in FIG. 3) and 90° (FIG. 5) and between 270° and 360° (position in FIG. 3); instead, they substantially act as struts for tilting angles of the converter with respect to the vertical, between 90° (position in FIG. 5) and 270°.

Figure 6:
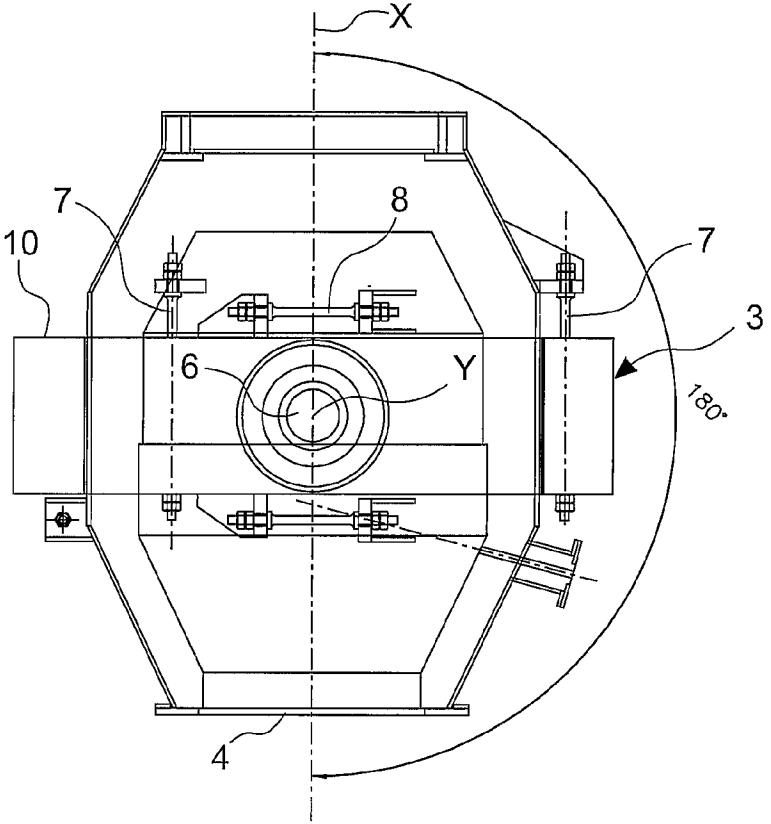
FIG. 6 shows the converter in FIG. 3, in a third operating position.

The position with tilting angle equal to 180° (shown in FIG. 6), with the loading mouth 4 facing downwards, is provided for cleaning operations of the container, once emptied.

The pairs of second elastic bars 8, 8' at the tilting pins 6 ensure optimal support, stability and rigidity of the container. Said pairs of bars 8 mainly serve to support the weight of the container when it is tilted by 90° (tapping position—FIG. 5). They substantially act as struts for tilting angles of the converter with respect to the vertical, comprised between 0° (position in FIG. 3) and 90° (FIG. 5) and between 270° and 360° (position in FIG. 3); instead, they substantially act as tie rods for tilting angles of the converter with respect to the vertical, comprised between 90° (position in FIG. 5) and 270°.

The presence of at least one third elastic bar 9 serves the function of preventing any movements/oscillations on the horizontal plane when the converter is tilted by 90° for the tapping step of the liquid steel.

The momentums generated with the rotation of the converter about the axis Y are perfectly absorbed by this configuration of elastic bars 7, 8, 8' and 9.

Instead, a second advantageous variant of the converter of the invention (not shown) provides a suspension system comprising:

- the three first elastic bars 7 arranged parallel to the axis X at an equal angular distance from each other with respect to said axis X;
- only two second elastic bars 8, 8', each second elastic bar being arranged close to a respective supporting pin 6, orthogonally to the first plane X-Y;
- a third elastic bar 9 arranged parallel to said first plane X-Y, spaced angularly by about 90° from said second elastic bars 8, 8', with respect to the axis X.

Good support, good stability and good rigidity of the container in all the operating steps thereof were also obtained using this second variant with only two elastic bars 8, 8'.

In both the variants, described above, of the converter of the invention, it is possible to provide a greater number of the first elastic bars 7 arranged parallel to axis X.

The number of said first elastic bars may advantageously be increased according to the load to be supported.

In the variants described above, the first three elastic bars 7 are arranged at 120° from each other (FIG. 1) to have an isostatic balance. This configuration allows excellent results to be achieved for an overall weight of the container equal to about 120 tons.

When there are larger loads, it is preferable to increase the number of the first bars by advantageously providing three groups of said first bars 7 rather than to design thicker first longitudinal elastic bars which would be less elastic. These groups of first bars 7 are substantially arranged at 120° from each other to continue having an isostatic balance. A greater number of thin first bars allows the load to be optimally distributed while keeping a suitable elasticity of the bars.

Figure 7:
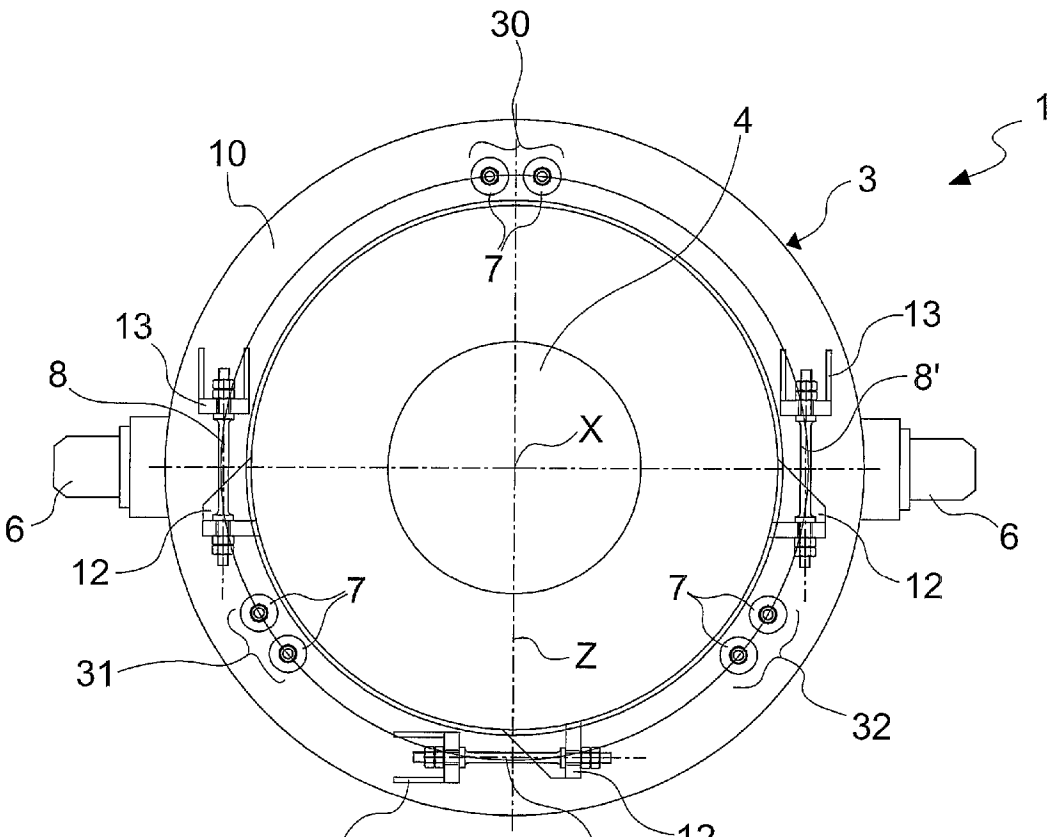
FIG. 7 shows a top view of a second embodiment of a converter according to the invention.

For example, according to a variant, it is possible to provide three groups of first bars 7, each group consisting of two first bars 7. This configuration (shown in FIG. 7) allows excellent results to be obtained for an overall weight of the container equal to about 240 tons.

Figure 8:
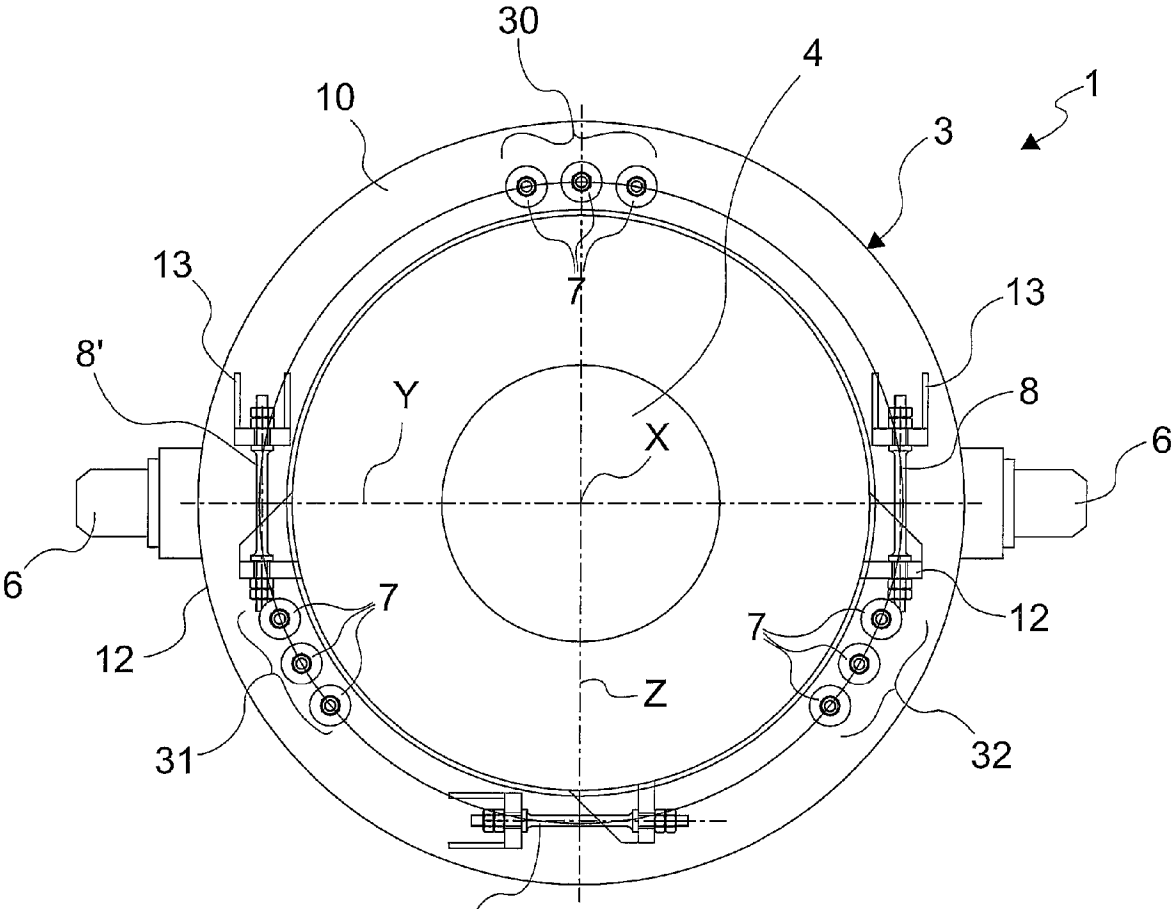
FIG. 8 shows a top view of a third embodiment of a converter according to the invention.

Instead according to a further variant, three groups of first bars 7 are provided, each group consisting of three first bars 7. This configuration (shown in FIG. 8) allows excellent results to be obtained for an overall weight of the container equal to about 360 tons.

The diameter of said first bars 7 may be, e.g., equal to about 200 mm.

Advantageously, all the first bars 7 are arranged, in the plan view, along a circumference. The at least one third elastic bar 9 is arranged diametrically opposite (180° to a first group 30 of said first bars 7 which are arranged close to the plane X-Z. Second group 31 and third group 32 of the first bars 7 are arranged symmetrically to each other with respect to the plane X-Z. The second elastic bars 8, 8' are arranged at an angular distance of ±90° from said first group 30 of first bars.

The invention claimed is:

1. A tiltable converter comprising a container defining a first axis;

a support ring, coaxial to the container and spaced from said container, equipped with two diametrically opposite supporting pins, defining a second axis which is orthogonal to the first axis, adapted to allow the converter to be rotated about said second axis;

suspension elements, connecting said container to said support ring, restrained at a first end to the container and at a second end to the support ring;

wherein said suspension elements comprise at least three first bars arranged parallel to the first axis and substantially equidistant from each other along said support ring;

at least two second bars, each second bar being orthogonal to said second axis and diametrically opposite with respect to the other second bar;

at least one third bar arranged parallel to a first plane, defined by said first axis and second axis, and orthogonal to said at least three first bars;

wherein said at least three first bars, said at least two second bars and said at least one third bar are bars having ends fixed in a rigid manner to the container and to the support ring.

2. A converter according to claim 1, wherein four second bars are provided, a first pair of said second bars being diametrically opposite with respect to a second pair.

3. A converter according to claim 2, wherein one bar in each pair of second bars is arranged at a first side of a second plane which is orthogonal to the first plane, while the other bar in the same pair is positioned at a second side of said second plane.

4. A converter according to claim 1, wherein only two second bars are provided, both arranged at a first side or at a second side of a second plane which is orthogonal to the first plane.

5. A converter according to claim 2, wherein said at least one third bar is arranged at a first side or a second side of said second plane.

6. A converter according to claim 4, wherein said at least one third bar is arranged at the first side or the second side of said second plane.

7. A converter according to claim 5, wherein two third bars are provided; one is arranged at the first side of the second plane of the converter, while the other is positioned at the second side of said second plane.

8. A converter according to claim 6, wherein two third bars are provided; one is arranged at the first side of the second plane of the converter, while the other is positioned at the second side of said second plane.

9. A converter according to claim 3, wherein said at least three first bars orthogonally cross said second plane.

10. A converter according to claim 4, wherein said at least three first bars orthogonally cross said second plane.

11. A converter according to claim 3, wherein the second bars are arranged close to the supporting pins and said at least one third bar is angularly spaced by about 90° from said second bars.

12. A converter according to claim 4, wherein the second bars are arranged close to the supporting pins and said at least one third bar is angularly spaced by about 90° from said second bars.

13. A converter according to claim 1, wherein first bars, second bars and said at least one third bar are substantially arranged along a side surface of a cylinder.

14. A converter according to claim 1, wherein said at least two second bars and said at least one third bar are restrained at a first end to the container and at the other end to the support ring by means of bolting on respective fastening brackets.

15. A converter according to claim 14, wherein the first bars are restrained at a first end to the container by means of bolting on a respective fastening bracket, and at a second end by means of bolting directly on a first surface of the support ring.

16. A converter according to any one of the preceding claims, wherein three groups of first bars are provided, said groups being substantially equidistant from each other along said support ring.

17. A converter according to claim 16, wherein each group consists of at least two first bars.

18. A converter according to claim 17, wherein each group consists of three first bars.

* * * * *